US009528709B2

(12) United States Patent
Hettinger et al.

(10) Patent No.: US 9,528,709 B2
(45) Date of Patent: Dec. 27, 2016

(54) LIGHTING SYSTEM FOR AN OVEN APPLIANCE

(71) Applicant: General Electric Company, Schenectady, NY (US)

(72) Inventors: Christopher Lee Hettinger, Louisville, KY (US); Justin Tyler Brown, Louisville, KY (US); Edward LaVoisier Muhammad, Ringgold, GA (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 14/700,329

(22) Filed: Apr. 30, 2015

(65) Prior Publication Data

US 2016/0320069 A1 Nov. 3, 2016

(51) Int. Cl.

| | |
|---|---|
| ***F24C 15/00*** | (2006.01) |
| ***F21V 29/70*** | (2015.01) |
| ***F21V 29/503*** | (2015.01) |
| ***F21V 29/15*** | (2015.01) |
| *F21W 131/307* | (2006.01) |
| *F21Y 101/02* | (2006.01) |

(52) U.S. Cl.

CPC ..... *F24C 15/008* (2013.01); *F21V 29/15* (2015.01); *F21V 29/503* (2015.01); *F21V 29/70* (2015.01); *F21W 2131/307* (2013.01); *F21Y 2101/02* (2013.01)

(58) Field of Classification Search

CPC ..... F24C 15/008; F21V 29/15; F21V 29/503; F21V 29/70; F21W 2131/307; F21Y 2101/02

USPC ..... 362/92

See application file for complete search history.

(56) References Cited

U.S. PATENT DOCUMENTS

| | | | | |
|---|---|---|---|---|
| 7,157,667 | B2 * | 1/2007 | Gramlich | F24C 15/04 126/190 |
| 7,252,402 | B2 * | 8/2007 | Gotz | F24C 15/008 362/89 |
| 7,874,690 | B2 | 1/2011 | Weber, III et al. | |
| 2011/0013383 | A1 | 1/2011 | Medinis | |
| 2011/0170287 | A1 | 7/2011 | Medinis | |
| 2013/0003351 | A1 * | 1/2013 | Wiedenmann | F24C 15/008 362/92 |
| 2013/0201657 | A1 * | 8/2013 | Arrigoni | F24C 15/008 362/92 |

* cited by examiner

*Primary Examiner* — Laura Tso

(74) *Attorney, Agent, or Firm* — Dority & Manning, P.A.

(57) ABSTRACT

An oven appliance including a cabinet having a first wall at least partially defining a cooking chamber configured for receipt of items to be cooked is provided. The oven appliance also includes a lighting system positioned adjacent to an opening defined by the first wall of the cabinet. The lighting system includes an optical feature and a light source positioned outside the cooking chamber and spaced from the opening in the first wall. The optical feature extends between the light source and the opening defined by the first wall to direct light from the light source into the cooking chamber when the lighting system is activated.

18 Claims, 6 Drawing Sheets

LIGHTING SYSTEM FOR AN OVEN APPLIANCE

FIELD OF THE INVENTION

The present disclosure relates generally to oven appliances, or more particularly to lighting systems for oven appliances.

BACKGROUND OF THE INVENTION

Conventional residential and commercial oven appliances generally include a cabinet that defines a cooking chamber for receipt of food items for cooking Access to the cooking chamber is generally provided through an oven door. Additionally, heating elements are positioned within the cooking chamber to provide heat to any food items located therein. The heating elements can include, for example, radiant heating elements, such as a bake heating element positioned at a bottom of the cooking chamber and/or a broil heating element positioned at a top of the cooking chamber.

Oven appliances typically also include a light positioned within the cooking chamber to allow a user to, e.g., monitor the food items in the cooking chamber during cooking operations. Incandescent or halogen lights are typically used for lighting an oven due to their ability to withstand relatively high temperatures. For example, certain incandescent and halogen lights, such as those used to light the cooking chamber of an oven appliance, may be capable of withstanding temperatures in excess of 900° F. These temperatures may occur during a "cleaning" cycle of the oven appliance.

However, certain incandescent and halogen lights can be inefficient and may have a relatively short lifespan. Accordingly, a lighting system for an oven appliance that could more efficiently illuminate the cooking chamber of an oven appliance would be useful. More particularly, a lighting system for an oven appliance that could reduce the frequency at which a user must replace a light source of the lighting system would be particularly beneficial.

BRIEF DESCRIPTION OF THE INVENTION

Aspects and advantages of the invention will be set forth in part in the following description, or may be apparent from the description, or may be learned through practice of the invention.

In accordance with one embodiment, an oven appliance is provided. The oven appliance includes a cabinet including a first wall at least partially defining a cooking chamber configured for receipt of items to be cooked. The first wall further defines an opening. The oven appliance additionally includes a lighting system having at least a portion positioned adjacent to the opening defined by the first wall of the cabinet. The lighting system includes a light source positioned outside the cooking chamber and spaced from the opening in the first wall of the cabinet. The lighting system additionally includes an optical feature extending between the light source and the opening defined by the first wall of the cabinet for directing light from the light source into the cooking chamber through the opening in the first wall when the lighting system is activated.

In accordance with another embodiment, an oven appliance is provided. The oven appliance defines a lateral direction and includes a cabinet including a first side wall and a second side wall spaced from one another along the lateral direction. The first and second side walls at least partially define a cooking chamber configured for receipt of items to be cooked. The first side wall further defines an elongated first opening. The oven appliance additionally includes a lighting system having at least a portion positioned adjacent to the first opening defined by the first side wall of the cabinet. The lighting system includes a light source including an array of lights positioned outside the cooking chamber and spaced from the opening in the first side wall of the cabinet. The lighting system additionally includes an optical feature extending between the light source and the opening in the first side wall of the cabinet for directing light from the light source into the cooking chamber through the opening in the first wall when the lighting system is activated.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION OF THE INVENTION

Figure 1:
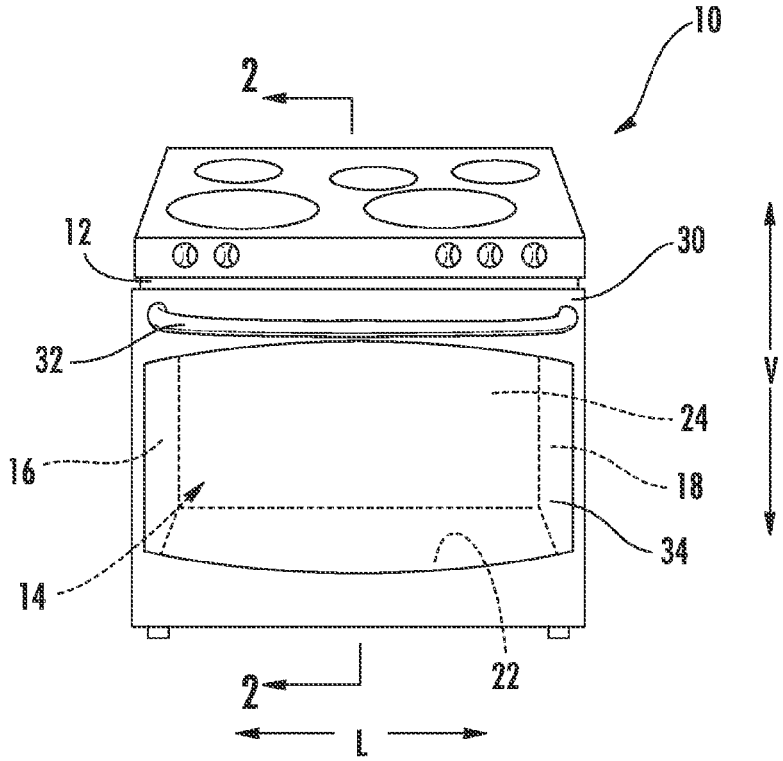
FIG. 1 provides a perspective view of an oven appliance in accordance with one embodiment of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
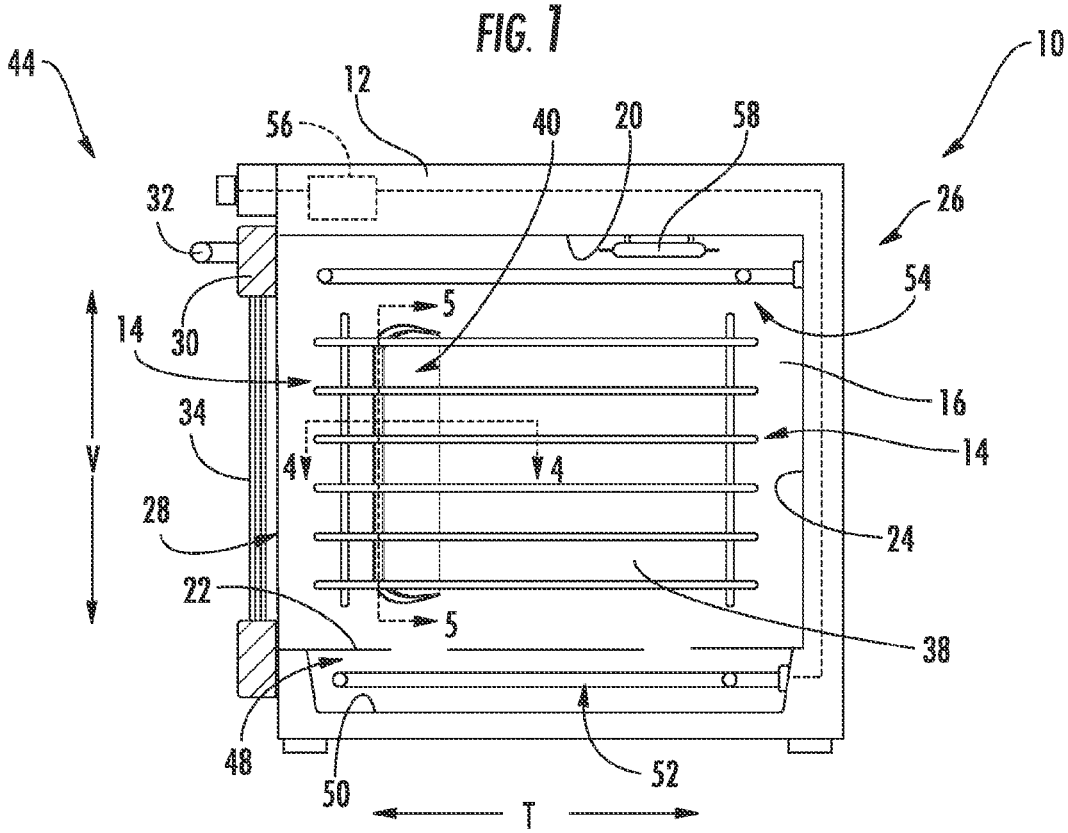
FIG. 2 provides a side cross-sectional view of the exemplary oven appliance of FIG. 1.
Figure 3:
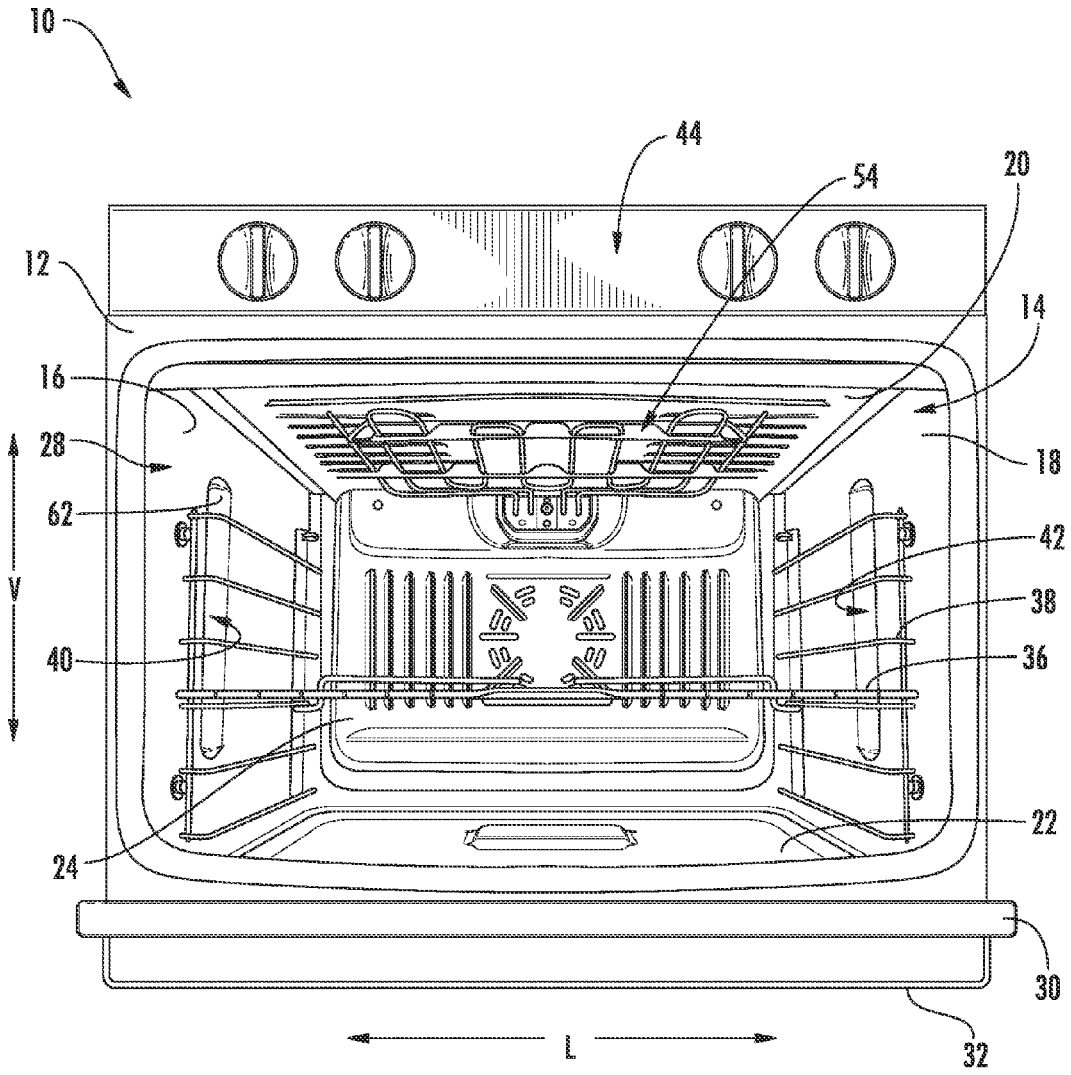
FIG. 3 provides a front view of the exemplary oven appliance of FIG. 1 with an oven door in an open position.

Referring now to the Figures, FIG. 1 provides a perspective view of an oven appliance 10 according to an exemplary embodiment of the present subject matter. Additionally, FIG. 2 provides a section view of oven appliance 10 taken along line 2-2 of FIG. 1 and FIG. 3 provides a front view of the oven appliance 10 of FIG. 1, with an oven door 30 in an open position.

Oven appliance 10 defines a vertical direction V, a lateral direction L, and a transverse direction T. The vertical, lateral and transverse directions V, L, T are mutually perpendicular and form an orthogonal direction system. As will be understood by those skilled in the art, oven appliance 10 is provided by way of example only, and the present subject matter may be used in any suitable oven appliance 10. Thus, the present subject matter may be used with other oven or range appliance configurations, e.g., that define multiple interior cavities for the receipt of food and/or having different pan or rack arrangements than what is shown in FIGS. 2 and 3. Additionally, the present subject matter may also be used with wall mounted oven appliances (not including a cooktop).

Oven appliance 10 includes an insulated cabinet 12 with an interior cooking chamber 14 defined by a plurality of walls. More particularly, cabinet 12 includes a first side wall 16 and a second side wall 18 spaced along the lateral direction L, a top wall 20 and a bottom wall 22 spaced along the vertical direction V, and a rear wall 24 positioned at a rear end 26 of oven appliance 10. First side wall 16, second side wall 18, top wall 20, bottom wall 22, and rear wall 24 each at least partially define cooking chamber 14.

Cabinet 12 additionally defines a cooking chamber opening 28 for access to cooking chamber 14. More particularly, cooking chamber 14 is configured for the receipt of one or more food items to be cooked through cooking chamber opening 28. Moreover, oven appliance 10 includes a door 30 rotatably mounted to cabinet 12, e.g., with a hinge (not shown) for covering cooking chamber opening 28. A handle 32 is mounted to door 30 and assists a user with moving door 30 between an open position (FIG. 3) and a closed position (FIGS. 1 and 2). For example, a user can pull on handle 32 to open door 30 and access cooking chamber 14. Notably, although the door 30 is depicted as a "pull-down" door, in other embodiments, any other suitable door configuration may be provided. For example, in other embodiments, the oven appliance 10 may include a French door configuration.

Oven appliance 10 can include a seal (not shown) between door 30 and cabinet 12 that assists with maintaining heat and cooking fumes within cooking chamber 14 when door 30 is closed as shown in FIGS. 1 and 2. Multiple parallel glass panes 34 provide for viewing the contents of cooking chamber 14 when door 30 is closed and assists with insulating cooking chamber 14. A baking rack 36 (FIG. 3) is positioned in cooking chamber 14 for the receipt of food items or utensils containing food items. Baking rack 36 is slidably received onto sliding rails 38 such that rack 36 may be conveniently moved into and out of cooking chamber 14 when door 30 is open.

As will be discussed in greater detail below, first side wall 16 defines a first protrusion 40 and second side wall 18 defines a second protrusion 42. For the embodiment depicted, the first and second protrusions 40, 42 are each elongated protrusions having a generally vertical orientation and positioned proximate to a front end 44 of the cooking chamber 14 along the transverse direction T. Additionally, oven appliance 10 includes a first lighting system 46 (see FIG. 4) with at least a portion positioned adjacent first protrusion 40 in first wall 16 and a second lighting system (not shown) with at least a portion positioned adjacent second protrusion 42 in second wall 18. More particularly, as may be appreciated from the view depicted in FIG. 3, the first lighting system 46 and second lighting system are each positioned outside the cooking chamber 14 and configured with the first and second protrusions 40, 42, respectively, such that the first lighting system 46 and second lighting system are generally obstructed from view relative to a reference point outside the cooking chamber 14. More particularly, for the embodiment depicted, the first and second lighting systems are generally not visible outside the cooking chamber 14. Accordingly, during activation of the first and/or second lighting systems, light is not directed directly from the lighting systems into eyes of a user.

Referring still to FIGS. 1 through 3, cabinet 12 further includes and defines a heating chamber 48. In general, the heating chamber 48 is disposed below the cooking chamber 14, such as along the vertical direction V. For example, heating chamber 48 is defined by the bottom wall 32 and a base wall 50 which are spaced apart along the vertical direction V. First side wall 16 and second side wall 18 further extend between the bottom wall 32 and base wall 50, and are spaced apart along the lateral direction L. Rear wall 38 may additionally extend between the bottom wall 32 and base wall 42 as well as between the first side wall 16 and second side wall 18. Heating chamber 48 is thus defined between the bottom wall 32, base wall 42, first side wall 16, second side wall 18, and rear wall 38.

A bottom heating element 52, e.g. a bake heating element, is disposed within the heating chamber 48. In exemplary embodiments as illustrated, the bottom heating element 52 is an electric heating element, as is generally understood. Alternatively, the bottom heating element 52 may be a gas burner or other suitable heating element having another suitable heating source. Heating element 52 is used to heat cooking chamber 14 for both cooking and cleaning of range appliance 10, as discussed herein.

Additionally, a top heating element 54, e.g. a broil heating element, may be disposed within the cooking chamber 14, such as adjacent top wall 30. In exemplary embodiments as illustrated, the top heating element 54 is an electric heating element, as is generally understood. Alternatively, the top heating element 54 may be a gas burner or other suitable heating element having another suitable heating source. Heating element 54 may additionally be used to heat cooking chamber 14 for both cooking and cleaning of range appliance 10, as discussed herein.

The operation of oven appliance 10 including heating elements 52 and 54 may be controlled by a processing device such as a controller 56. Controller 56 may be in communication (via for example a suitable wired or wireless connection) to the heating elements 52, 54 and other suitable components of the oven appliance 10, such as a fan. By way of example, the controller 56 may include a memory and one or more processing devices such as microprocessors, CPUs or the like, such as general or special purpose microprocessors operable to execute programming instructions or micro-control code associated with operation of appliance 10. The memory may represent random access memory such as DRAM, or read only memory such as ROM or FLASH. In one embodiment, the processor executes programming instructions stored in memory. The memory may be a separate component from the processor or may be included onboard within the processor.

Such controller 56 may also be communication with a temperature sensor 58 that is used to measure temperature inside cooking chamber 14 and provide such measurements to the controller 56. Temperature sensor 58 is shown (in FIG. 2) in the top and rear of cooking chamber 14. However, other locations may be used and, if desired, multiple temperature sensors may be applied as well.

Controller 56 is operable to activate various cooking modes based on, for example, user selection thereof. For example, controller 56 may be operable to activate a preheat mode and one or more cooking modes, such as a bake mode and/or a broil mode. Preheat mode may generally be a mode in which the cooking chamber 14 is initially heated in preparation for a cooking mode, such as bake mode or broil mode. Cooking modes, such as bake and broil modes may variously be utilized to cook food items, etc. within the cooking chamber 14. Heating element 52, as well as heating element 54, may be operable to heat the cooking chamber 14 during operation of the oven appliance 10 in, for example, a preheat mode and/or cooking mode.

Figure 4:
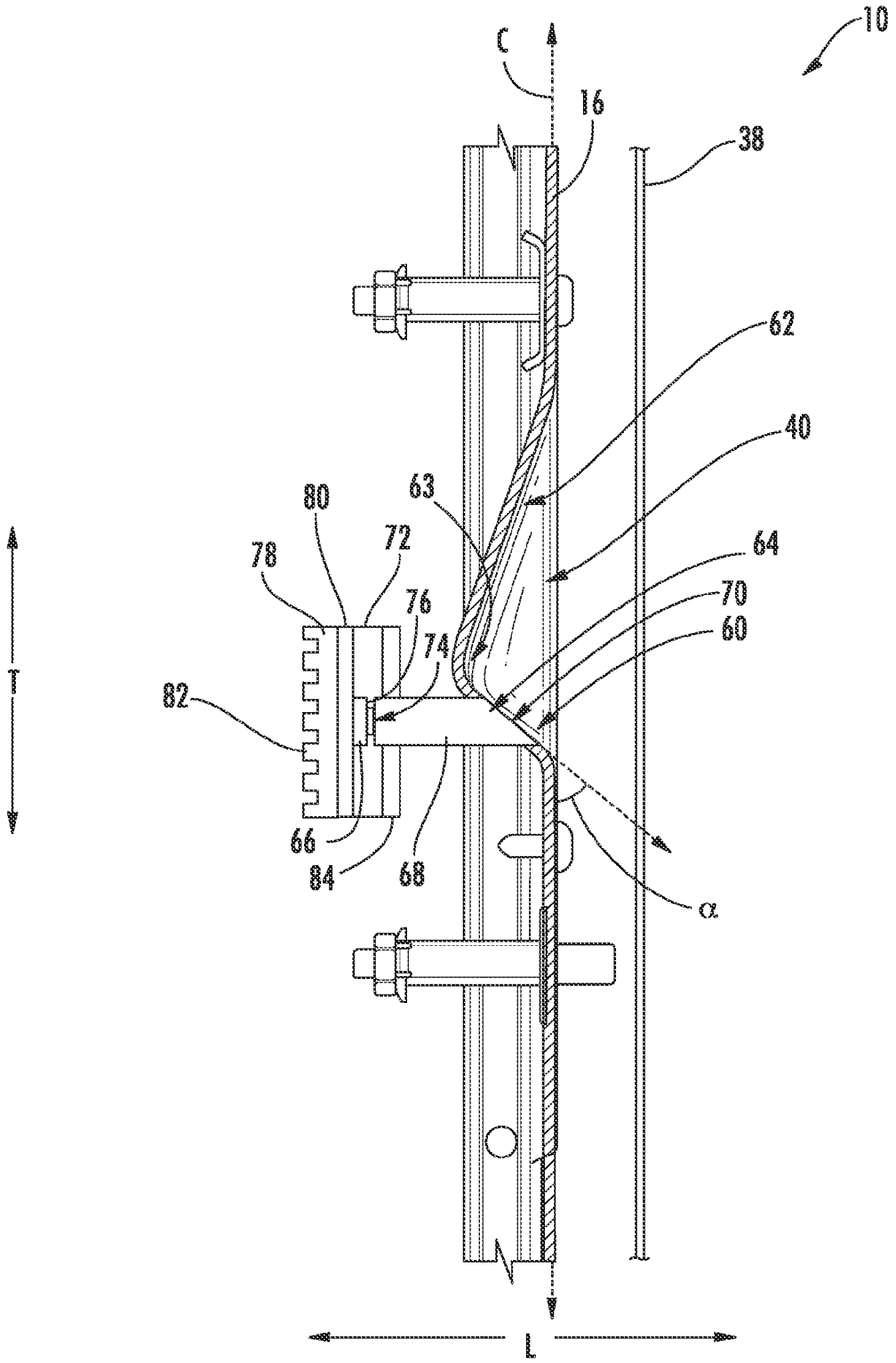
FIG. 4 provides a top, cross-sectional view of a portion of the exemplary oven appliance of FIG. 1, along line 4-4 of FIG. 2.
Figure 5:
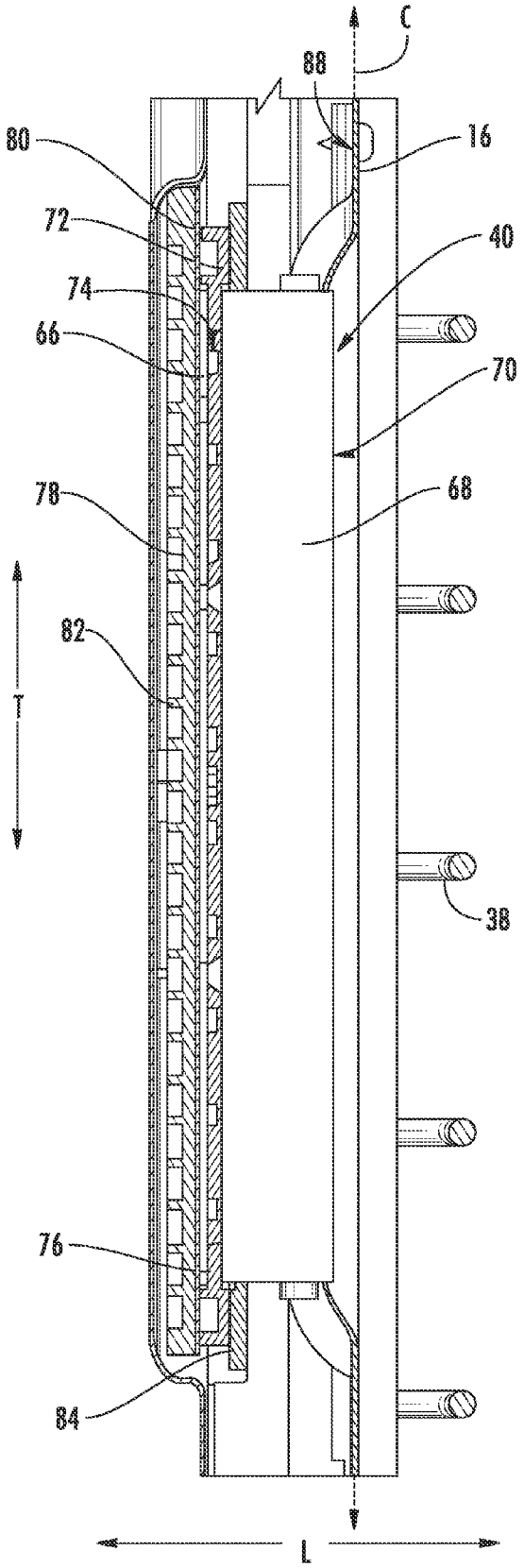
FIG. 5 provides a side, cross-sectional view of a portion of the exemplary oven appliance of FIG. 1, along line 5-5 of FIG. 2.

Referring now to FIGS. 4 and 5, the first side wall 16 and first lighting system 46 are shown in greater detail. More particularly, FIG. 4 provides a cross-sectional view of oven appliance 10 taken along line 4-4 of FIG. 2 and FIG. 5 provides a cross-sectional view of the oven appliance 10 taken along line 5-5 of FIG. 2.

As is shown, the first side wall 16 additionally defines a central plane C extending in the vertical direction V and the transverse direction T. The first protrusion 40 in the first side wall 16 extends outwardly from the central plane C in a direction away from the second side wall 18. Additionally, the protrusion 40 includes a near section 60 and a far section 62 separated by a crease 63. The near section 60 is positioned closer to the cooking chamber opening 28 defined by the cabinet 12 than the far section 62. Further, referring particularly to FIG. 4, the near section 60 of the first protrusion 40 in the first wall 16 defines an angle $\alpha$ relative to the central plane C of the first wall 16. For the embodiment depicted, the angle $\alpha$ is greater than or equal to about fifteen (15) degrees. It should be appreciated, however, that in other exemplary embodiments, the near section 60 of the first protrusion 40 in the first wall 16 may define any other suitable angle relative to the central plane C. For example, in other exemplary embodiments, the angle $\alpha$ may be greater than or equal to about thirty (30) degrees, or alternatively may be greater than or equal to about forty-five (45) degrees. It should be appreciated, that as used herein, terms of approximation such as "about" or "approximately" refer to being within a ten percent (10%) margin of error.

As stated, the oven appliance 10 further includes the first lighting system 46. The first lighting system 46 includes at least a portion positioned adjacent to or extending through the near section 60 of the first protrusion 40 in the first wall 16. The first lighting system 46 is positioned such that the first lighting system 46 is obstructed from view generally along the central plane C of the first wall 16 from the cooking chamber opening 28. More particularly, for the embodiment depicted, near section 60 of the first protrusion 40 in the first wall 16 defines an opening 64 and a portion of the first lighting system 46 extends into the opening 64. As may be most clearly seen in FIG. 5, for the embodiment depicted, the opening 64 is an elongated opening having a generally vertical orientation. It should be appreciated, however, that in other exemplary embodiments, the opening 64 may have any other suitable shape or configuration.

Figure 6:
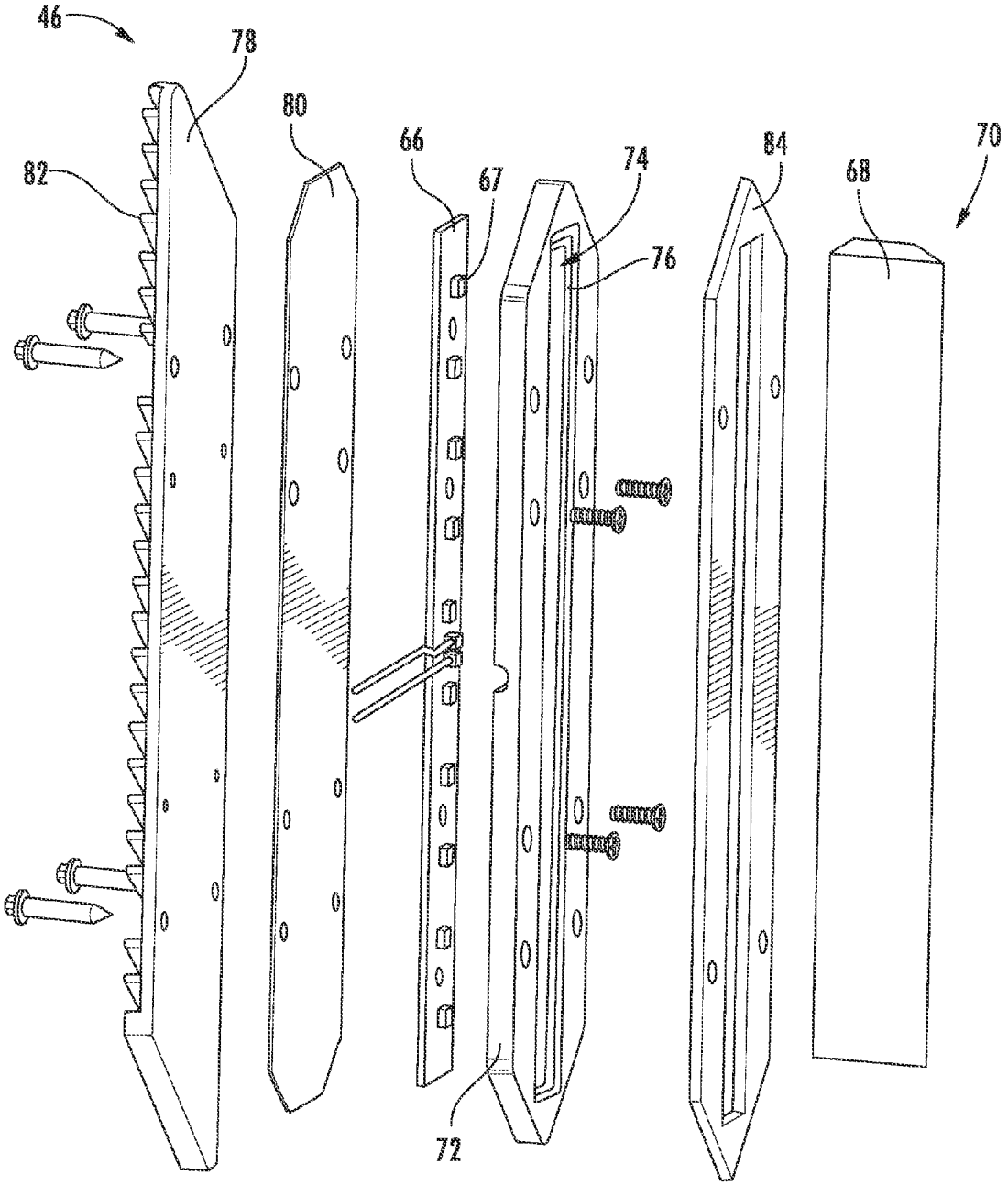
FIG. 6 provides an exploded perspective view of a first lighting system of the exemplary oven appliance of FIG. 1.

Referring now also to FIG. 6, providing an exploded perspective view of the first lighting system 46, first lighting system 46 generally includes a light source 66 and an optical feature 68. The light source 66 is positioned outside the cooking chamber 14 and spaced along the lateral direction L from the near section 60 of the first protrusion 40 in the first wall 16. Additionally, the optical feature 68 extends between the light source 66 and the near section 60 of the first protrusion 40. The light source 66 may therefore provide light through the opening 64 in the near section 60 of the first protrusion 40 into the cooking chamber 14 when activated. More particularly, for the embodiment depicted, the light source 66 is configured to provide light into the optical feature 68 when activated and the optical feature 68 is configured for directing such light from the light source 66 through the opening 64 and into the cooking chamber 14 when the lighting system 46 is activated.

The light source 66 depicted includes one or more light emitting diodes ("LEDs") 67. More particularly, as may be more clearly seen in FIGS. 5 and 6, the light source 66 depicted includes an array of LEDs 67. Additionally, the optical feature 68 depicted is a piece of glass extending between the light source 66 and into and/or through the opening 64 in the near section 60 of the first protrusion 40. Moreover, referring particularly to FIG. 4, the optical feature 68 extends in a direction substantially perpendicular to the central plane C of the first side wall 16 and also defines an inside surface 70 exposed to the cooking chamber 14. The inside surface 70, for the embodiment depicted, extends in a plane substantially parallel to, and is substantially flush with, a plane defined by the opening 64 in the near section 60 of the first protrusion 40.

In certain embodiments, the optical feature 68 may physically contact the light source 66, or alternatively, the optical feature 68 may be positioned in close proximity to the light source 66, such as in the exemplary embodiment depicted. More particularly, for the embodiment depicted, the first lighting system 46 includes a housing 72 defining an opening 74 configured to receive the light source 66 on one side and the optical feature 68 on the other. The housing 72 includes a flange 76 extending inwardly around an inside perimeter of the opening 74, contacting a portion of the optical feature 68 on one side and a portion of the light source 66 on the other side.

The first lighting system 46 further includes a heat sink 78 in thermal communication with the light source 66 and an electrical insulation layer 80 disposed between heat sink 78 and light source 66. Heat sink 78 includes a plurality of fins 82 to assist in dissipating heat and may be formed of any material having a relatively high thermal conductivity. Additionally, electrical insulation layer 80 may be comprised of any material having a relatively high electrical resistivity (i.e., a relatively low electrical conductivity).

The first lighting system 46 depicted further includes a thermal insulation layer 84 positioned between the light source 66 and the first wall 16 of the cabinet 12 and disposed on an opposite side of the light source 66 and housing 72 from the heat sink 78. Thermal insulation layer 84 may be formed of a material having a relatively low thermal conductivity and thus may prevent at least a portion of the heat from the cooking chamber 14 from reaching the light source 66. Moreover, although not depicted, the oven appliance 10 may additionally include one or more additional layers of insulation adjacent to first wall 16 of the cabinet 12 and, e.g., surrounding one or more portions of the first lighting system 46, such as the optical feature 68 of the first lighting system 46.

Such a configuration may allow for a lighting system 46 having a light source 66 including one or more LEDs, which previously have not been acceptable for providing light to a cooking chamber 14 of an oven appliance 10 due to a relatively low nominal operating temperature range for LEDs. More particularly, such configuration may maintain a temperature of the light source 66 below the nominal operating temperature range for LEDs, despite the relatively high temperatures of the cooking chamber 14, especially during a "clean" mode.

It should be appreciated, however, that the first lighting system 46 described herein is by way of example only. For example, in other exemplary embodiments, the light source 66 may include any other suitable lights, such as incandescent or halogen lights. Additionally, the optical feature 68 may be any material capable of directing light from the light source 66 into the cooking chamber 14, and may have any other suitable shape or configuration for directing light in such a manner. Moreover, in still other exemplary embodiments, the first lighting system 46 may include other features not described herein, or alternatively may not include one or more of the features described herein (e.g., the heat sink 78, the electrical insulation layer 80, and/or the thermal insulation layer 84).

Figure 7:
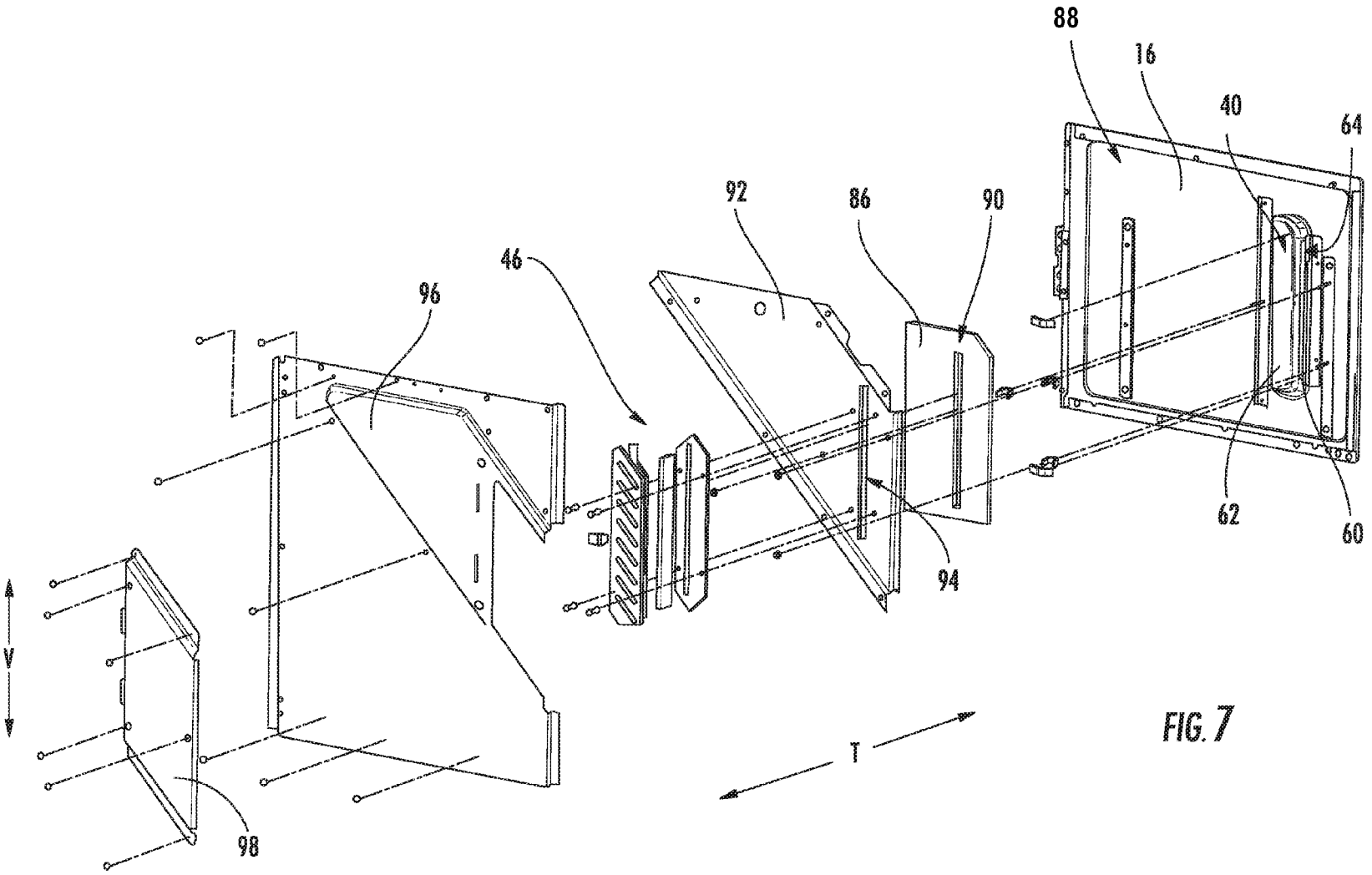
FIG. 7 provides an exploded view of a first side of the exemplary oven appliance of FIG. 1.

Referring now to FIG. 7, an exploded view of a first side of oven appliance 10 is provided. As shown, for the embodiment depicted, a first insulation layer 86 is provided adjacent to an outside surface 88 of first side wall 16. More particularly, the first insulation layer 86 covers the first protrusion 40 in the first wall 16. The first insulation layer 86 includes an elongated slot 90 that aligns with the elongated opening 64 in the near section 60 of the first protrusion 40 in the first wall 16.

Additionally, an inner panel 92 is provided over the first insulation layer 86 and attached to the first side wall 16. The inner panel 92 also includes an elongated slot 94 that aligns with elongated slot 90 in the first insulation 86 layer and elongated opening 64 in the near section 60 of the first protrusion 40 in the first wall 16. The first lighting system 46 is configured to attach to the inner panel 92. When attached to the inner panel 92, the optical feature 68 of the first lighting system 46 extends through the elongated slots 90, 94 of the first insulation layer 86 and the inner panel 92, respectively, and into the elongated opening 64 in the near section 60 of the first protrusion 40 in the first wall 16 (see FIGS. 4 and 5).

An outer panel 96 is also provided, extending over and attaching to the inner panel 92. The outer panel 96 at least partially defines a cooling duct with the inner panel 92 configured to receive a cooling airflow from, e.g., a front of the oven appliance 10 during operation of the oven appliance 10. As depicted, the heat sink 78 of the first lighting system 46 is positioned at least partially within the cooling duct of the oven appliance 10 such that the heat sink 78 is exposed to the cooling airflow during operation of the oven appliance 10. Such a configuration may further reduce a temperature of the light source 66 of the first lighting system 46 during operation of the oven appliance 10.

Moreover, the oven appliance 10 includes a removable panel 98 attached to the outer panel 96 over the first lighting system 46. The removable panel 98 forms, at least in part, the cooling duct. The removable panel 98 may be removed from the outer panel 96 to allow a user to, e.g., conduct any maintenance operations on the first lighting system 46.

Referring back briefly to FIG. 3, it should be appreciated that the exemplary oven appliance 10 additionally includes the second lighting system. The second lighting system and second side wall 18 may be configured in substantially the same manner as the first lighting system 46 and first side wall 16. For example, the second side wall 18 may also define a central plane extending in the vertical and transverse directions V, T with the second protrusion 42 extending outwardly from the central plane of the second side wall 18 in a direction away from the first side wall 16. The second protrusion 42 in the second side wall 18 may also include a near section and a far section, with the near section positioned closer to the cooking chamber opening 28 defined by the cabinet 12 than the far section. Additionally, at least a portion of the second lighting system may be positioned adjacent to or extend through an opening in the near section of the second protrusion 42 in the second wall 18, such that the second lighting system is obstructed from view generally along the central plane of the second wall as viewed from the cooking chamber opening 28.

It should be appreciated that the oven appliance 10 depicted in FIGS. 1 through 7 and described herein is by way of example only. In other exemplary embodiments, the oven appliance 10 may have any other suitable configuration. For example, in other exemplary embodiments the oven appliance 10 may only include a single lighting system, such as the first lighting system 46. Additionally, or alternatively, in other exemplary embodiments, the oven appliance 10 may include one or more lighting systems configured with protrusions in, e.g., the top wall 20, the bottom wall 22, or the rear wall 24. Further, in still other exemplary embodiments, the oven appliance 10 may include a plurality of lighting systems configured with a corresponding plurality of protrusions defined in, e.g., first side wall 16 and/or second side wall 18. Moreover, in still other exemplary embodiments, the first and/or second protrusions 40, 42 in the first and/or second side wall 16, 18 may have any other suitable shape for orientation. For example, in other exemplary embodiments, the first and/or second protrusions 40, 42 may define a generally circular shape.

Furthermore, it should be appreciated that in still other exemplary embodiments, the first side wall 16 of the oven appliance 10 may not define a first protrusion 40. In such an exemplary embodiment, the optical feature 68 of the first lighting system 46 may extend into and/or through an opening defined in any suitable location of the first side wall 16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance comprising:

a cabinet comprising a first wall at least partially defining a cooking chamber configured for receipt of items to be cooked, the first wall further defining an opening; and a lighting system having at least a portion positioned adjacent to the opening defined by the first wall of the cabinet, the lighting system including a light source positioned outside the cooking chamber and spaced from the opening in the first wall of the cabinet;

an optical feature extending between the light source and the opening defined by the first wall of the cabinet for directing light from the light source into the cooking chamber through the opening in the first wall when the lighting system is activated; and a heat sink in thermal communication with the light source, wherein the heat sink is positioned at least partially within a cooling duct of the oven appliance such that the heat sink is exposed to a cooling airflow during operation of the oven appliance.

2. The oven appliance of claim 1, wherein the light source includes one or more light emitting diodes.

3. The oven appliance of claim 2, wherein the light source includes an array of light emitting diodes.

4. The oven appliance of claim 1, wherein the optical feature is a piece of glass extending between the light source and the opening in the first wall of the cabinet.

5. The oven appliance of claim 1, wherein the oven appliance includes a panel positioned over the lighting system, the panel forming at least in part the cooling duct.

6. The oven appliance of claim 5, wherein the panel is a removable panel.

7. The oven appliance of claim 1, wherein the lighting system further includes an electrical insulation layer disposed between the heat sink and the light source.

8. The oven appliance of claim 1, wherein the lighting system further includes a thermal insulation layer positioned between the light source and the wall of the cabinet.

9. The oven appliance of claim 8, wherein the heat sink is disposed on an opposite side of the light source from the thermal insulation layer.

10. The oven appliance of claim 1, wherein the first wall of the cabinet is a first side wall of the cabinet, wherein the cabinet further comprises a second side wall spaced from the first side wall along the lateral direction, wherein the second side wall defines a second opening, and wherein the oven appliance further includes a second lighting system configured for providing light to the cooking chamber through the second opening when activated.

11. An oven appliance defining a lateral direction, the oven appliance comprising:

a cabinet comprising a first side wall and a second side wall spaced from one another along the lateral direction, the first and second side walls at least partially defining a cooking chamber configured for receipt of items to be cooked, the first side wall further defining an elongated first opening; and a lighting system having at least a portion positioned adjacent to the first opening defined by the first side wall of the cabinet, the lighting system including a light source comprising an array of lights positioned outside the cooking chamber and spaced from the opening in the first side wall of the cabinet;

an optical feature extending between the light source and the opening in the first side wall of the cabinet for directing light from the light source into the cooking chamber through the opening in the first wall when the lighting system is activated; and a heat sink in thermal communication with the light source, wherein the heat sink is positioned at least partially within a cooling duct of the oven appliance such that the heat sink is exposed to a cooling airflow during operation of the oven appliance.

12. The oven appliance of claim 11, wherein the light source includes one or more light emitting diodes.

13. The oven appliance of claim 11, wherein the optical feature is a piece of glass extending between the light source and the opening in the first side wall of the cabinet.

14. The oven appliance of claim 11, wherein the oven appliance includes a panel positioned over the lighting system, the panel forming at least in part the cooling duct.

15. The oven appliance of claim 14, wherein the panel is a removable panel.

16. The oven appliance of claim 11, wherein the lighting system further includes an electrical insulation layer disposed between the heat sink and the light source.

17. The oven appliance of claim 11, wherein the lighting system further includes a thermal insulation layer positioned between the light source and the first side wall of the cabinet.

18. The oven appliance of claim 17, wherein the heat sink is disposed on an opposite side of the light source from the thermal insulation layer.

* * * * *